US007055197B1

(12) United States Patent
Fathali

(10) Patent No.: US 7,055,197 B1
(45) Date of Patent: Jun. 6, 2006

(54) MULTI-PILLOW CONSTRUCTION

(76) Inventor: Abbas Fathali, 18444 Purdue Dr., Saratoga, CA (US) 95070

( * ) Notice: Subject to any disclaimer, the term of this patent is extended or adjusted under 35 U.S.C. 154(b) by 0 days.

(21) Appl. No.: 11/127,833

(22) Filed: May 12, 2005

(51) Int. Cl.
*A47G 9/00* (2006.01)

(52) U.S. Cl. ..... 5/636; 5/644; 5/645
(58) Field of Classification Search ..... 5/636, 5/640, 643, 644, 645
See application file for complete search history.

(56) References Cited

U.S. PATENT DOCUMENTS 4,192,029 A * 3/1980 Bond ..... 5/644
5,070,558 A * 12/1991 Fenley ..... 5/636
5,528,784 A * 6/1996 Painter ..... 5/640
5,661,862 A * 9/1997 Ryndak ..... 5/636

* cited by examiner

*Primary Examiner*—Alexander Grosz
(74) *Attorney, Agent, or Firm*—William W. Bodnar

(57) ABSTRACT

The present invention provides a top and base pillow construction to support a person reclining in a hemi side position. The unique construction includes support means to hold the form of the top pillow and fasten it to the base pillow while providing an unobstructed area for a person's nasal openings. Two sets of this unique top and base pillow construction can also be combined to result in a double top pillow construction for use by two individuals sharing the same reclining space.

16 Claims, 3 Drawing Sheets

MULTI-PILLOW CONSTRUCTION

CROSS REFERENCE TO RELATED APPLICATIONS

None.

BACKGROUND OF INVENTION

1. Field of Invention

This present invention relates to a multi-pillow construction to be utilized during sleeping and/or reclining and provides head and neck support for the hemi side sleeper.

2. Related Art

There are three basic reclining positions, namely, prone, supine, and hemi side. In the hemi side position a person rests upon one of his/her upper arms and a single temple and facial cheek are downward. It is well known that the hemi side position is better than prone or supine for certain maladies. For example, the hemi side position is known to reduce snoring during sleep, to enhance the drainage of nasal and sinus fluids accompanying infections and congestion, and to facilitate breathing thereby reducing the likelihood of sleep apnea. It should be noted that the hemi side position is known to produce these benefits as long as the pillow itself does not block the nasal passages or otherwise inhibit breathing. Even in the absence of a medical condition, persons with nasal openings free from external obstructions during sleep will generally be benefited.

Pillow like devices for supporting the head and neck of hemi side reclining persons are taught in the related art including, inter alia, U.S. Pat. No. 4,192,029 and U.S. Pat. No. 5,661,862. However, these related art structures do not reliably support the user in a truly hemi side position while assuring that that is no obstruction to the user's nasal openings due to the pillow device itself. Also, the related art does not offer the advantages of two distinct pillows formed into multi-pillow construction as the present invention does.

U.S. Pat. No. 4,192,029 provides a head and neck supportive device for hemi side reclining persons but the device is a single pillow with plural segments, preferably in the form of three hingedly connected independent segments. This segmented construction with triangular-shaped end segments was designed for geriatric patients to use for cradling purposes. The major disadvantage of this design is it utilizes single pillow construction which does not provide the advantages of the present invention as explained below.

U.S. Pat. No. 5,661,862 provides a multitiered pillow construction which consists of pillow compartments which supply the different tiers. Although compartmentalized, the U.S. Pat. No. 5,661,862 patent also has the limitations and disadvantages of single pillow construction.

BACKGROUND OF INVENTION—OBJECTS AND ADVANTAGES

The present invention addresses the problem of providing a hemi side head and neck support while allowing the user to have his/her nasal passages unobstructed by the pillow construction. It also provides a separate top and base pillow construction which allows more flexibility and variability for pillow stuffing and hence support provided by the top and base pillows.

It is an object of the present invention to provide a multi-pillow construction that provides a user with proper head and neck support when reclining in a hemi side position. It is also an object of the present invention to allow the user's nasal passage to be unobstructed by the pillow construction itself when utilized in a hemi side reclining position.

It is a further object of the invention to provide a pillow construction that will allow the user to choose the firmness of the top pillow and/or the base pillow. Yet another advantage of the two-pillow, two-tiered configuration is to provide the user with a choice of surfaces upon which to lay his/her head. Each surface provided to the user still allows the user's nasal openings to be unobstructed by the pillow itself.

Another advantage of an embodiment of the present invention is to provide a double top pillow configuration to accommodate two people who are utilizing the same reclining/sleeping area. As stated previously, the top pillow can have pillow filling and firmness different from the base pillow. By the same measure, the double top pillow configuration allows each user to determine the firmness of each top pillow for maximum personal comfort.

SUMMARY OF INVENTION

The present invention provides a top and base pillow construction to support a person reclining in a hemi side position. The unique constructions includes support means to hold the form of the top pillow and fasten it to the base pillow while providing an unobstructed area for a person's nasal openings. Two sets of this unique top and base pillow construction can also be combined to result in a double top pillow construction for use by two individuals sharing the same reclining space.

BRIEF DESCRIPTION OF DRAWINGS

The character of the invention, however, may be best understood by reference to its structural forms, as illustrated by the accompanying drawings, in which.

DETAILED DESCRIPTION (OF A PREFERRED EMBODIMENT)

Figure 1:
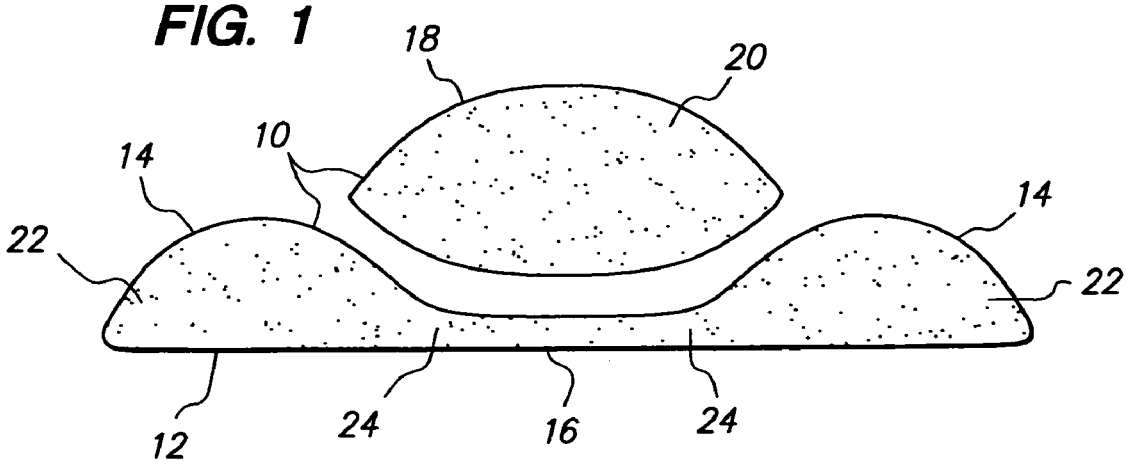
FIG. 1 is a front view of the top and base pillow configuration.

Referring to FIG. 1, which best shows the general features of a preferred embodiment of the invention, the two-pillow, top and base pillow configuration 10 is shown. In this configuration the base pillow 12 has two end sections 14 and a middle section 16. The middle section 16 contains less pillow stuffing 22 than the end sections 14 due to compartmentalization means 24 which limits the amount of pillow stuffing in the middle section 16. The compartmentalization means can be by any acceptable method of restricting the amount of material between sections including but not limited to stitching, buttons, fasteners, etc. in conjunction with the shape of the shell of the middle section. In FIG. 1 the compartmentalization means is primarily the narrowing shape of the shell at 24. Additional methods such as stitching, buttons, etc. can further control the volume of material in the middle 16 and end 14 sections of the base.

Figure 2:
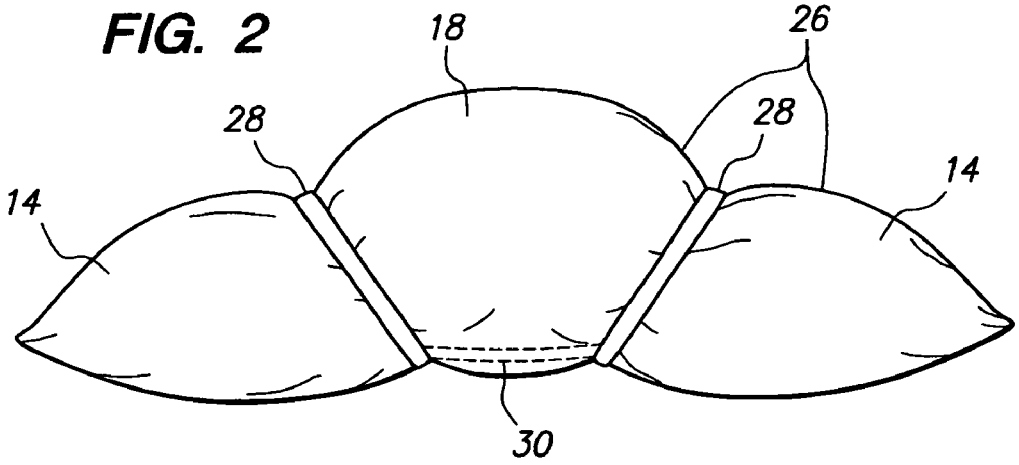
FIG. 2 is a front view of the top and base pillow configuration with straps and a pillow case.

FIG. 2 shows the top and base pillow configuration of FIG. 1 after a first pillow case 26 encloses the top and base pillow. Straps 28 are used to shape and support the top pillow to achieve the desired form shown. A bottom strap 30 is also utilized to maintain the relative position of the side straps 28 and further support and maintain the shape of the top pillow 18 in relation to the base pillow 12. The use of straps or some other supporting and securing means is critical to the present invention. The straps 28 shown in FIG. 2 help form the top pillow to the desired shape and hold that shape while being secured to the base pillow. The straps 28 also create an indentation or crease or crevice in the vicinity of where the top pillow 18 and the base pillow 12 meet. This indentation forms a pocket area which provides a space to accommodate a hemi side reclining person's nose and/or mouth. The bottom strap 30 assures the integrity of top and base pillow shapes by securing the side straps 28 at the bottom of the base pillow 12. The bottom strap also preserves the integrity of the indentations formed by side straps 28.

Figure 3:
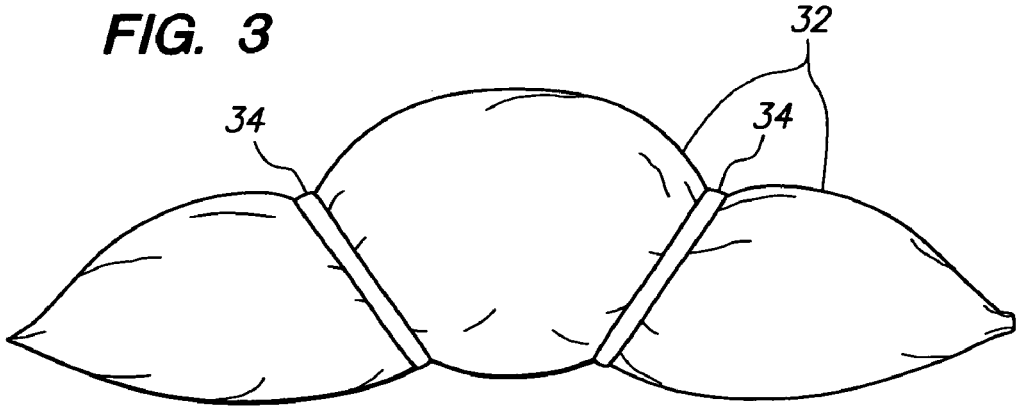
FIG. 3 is a front view of the top and base pillow configuration with a second (outer) case and second (outer) set of straps.

FIG. 3 shows the top and base pillow configurations of FIGS. 1 and 2 with a second pillow case 32 enclosing the first case. The second case shown includes a second set of side straps 34 to maintain the shape of the two-pillow configuration. Although straps are shown, any shaping means to allow the second case to maintain the underlying form of the pillow construction enclosed will suffice. The purpose of the shaping means is to maintain the integrity of the indentation described above so a users nose and/or mouth are not obstructed.

Figure 4:
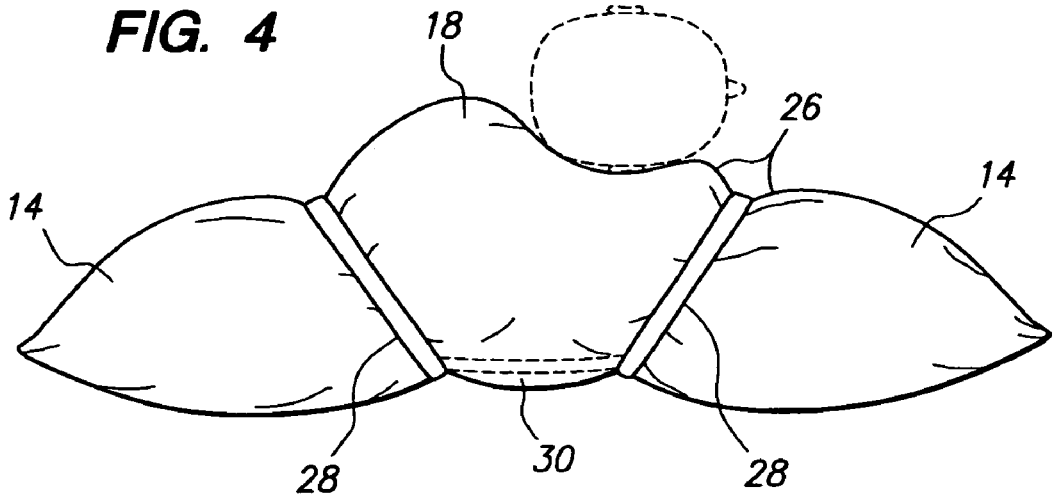
FIG. 4 is a front view of the top and base pillow configuration in use with a person's head positioned on the top pillow.

FIG. 4 shows a person utilizing the top and base pillow configuration of FIGS. 1–3. The head of the person is positioned on its side on the top pillow 18 to illustrate the hemi side position.

Figure 5:
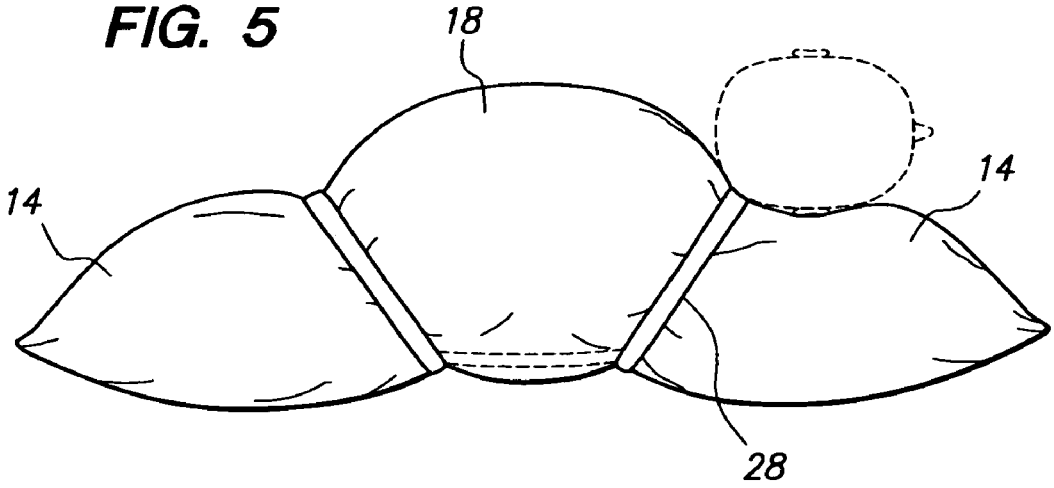
FIG. 5 is a front view of the top and base pillow configuration in use with a person's head positioned on an end section of the base pillow.

FIG. 5 shows a person utilizing the top and base pillow configuration of FIGS. 1–3. The head of the person is positioned on its side on the end section 14 of the base pillow.

Figure 6:
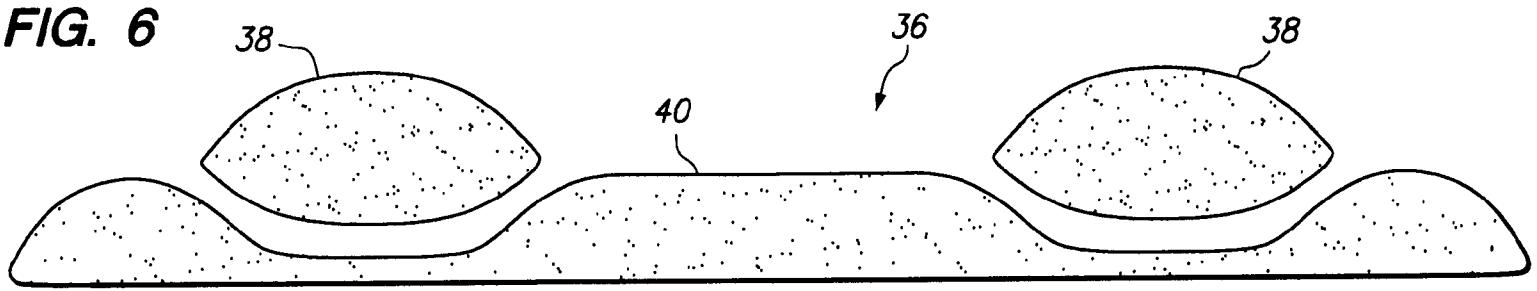
FIG. 6 is a front view of the double top pillow configuration.

FIG. 6 shows the double top pillow configuration with two top pillows 38 and an elongated base pillow 40. As clearly seen, the base section is the approximate equivalent of two base sections from the top and base configuration shown in FIG. 1. The top pillows are situated above the narrower section of the base pillows as shown. These narrower sections can be referred to as receiving sections of the base pillow.

Figure 7:
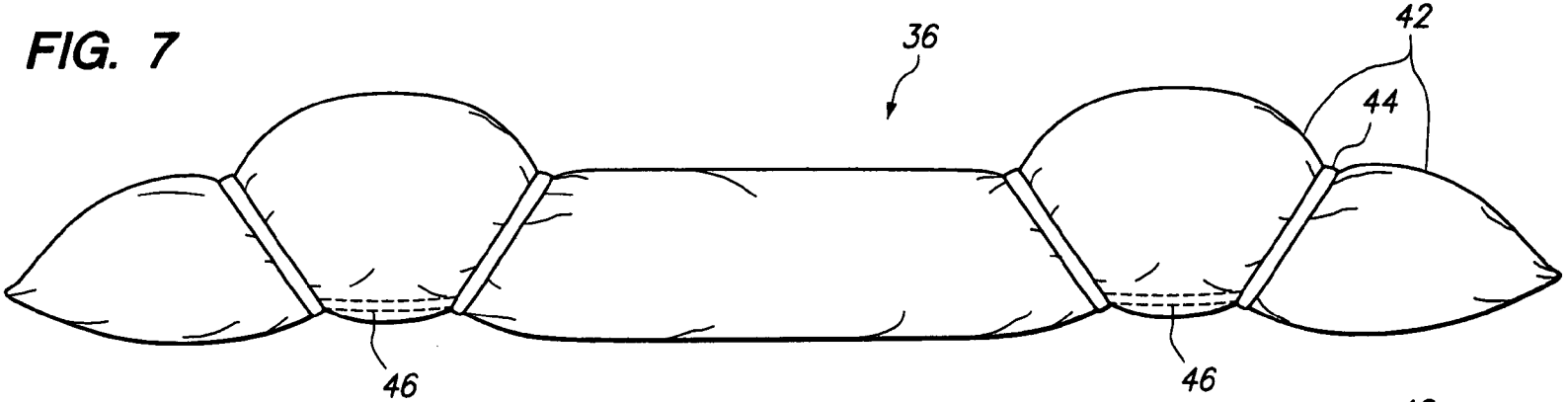
FIG. 7 is a front view of the double top pillow configuration with straps and a pillow case.

FIG. 7 shows the double top pillow configuration of FIG. 6 after a first pillow case 42 encloses the two top pillows and base pillow. Straps 44 are used to form and support the top pillows to achieve the desired shapes. Two bottom straps 46 are also utilized to maintain the relative position of the side straps 44 and further support and maintain the shape of the top pillows 38 in relation to the base pillow 40.

Figure 8:
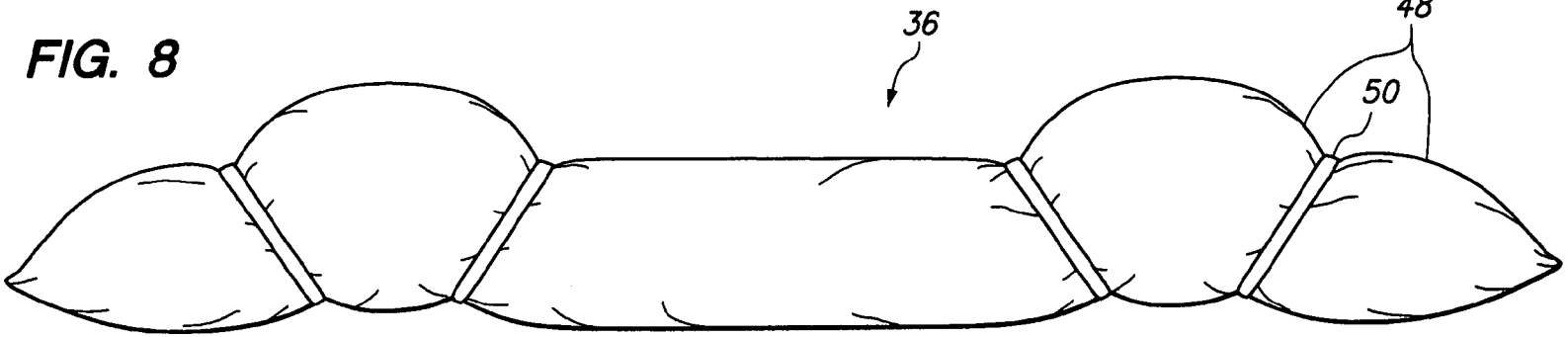
FIG. 8 is a front view of the double top pillow configuration with a second (outer) case and second (outer) set of straps.

FIG. 8 shows the double top pillow configurations of FIGS. 6 and 7 with a second pillow case 48 enclosing the first case. The second case shown includes a second set of support straps 50 to maintain the shape of two top pillows in relation to the base pillow in this double top pillow configuration.

CONCLUSIONS, OTHER EMBODIMENTS, AND SCOPE OF INVENTION

Accordingly, the reader can see that the two pillow construction utilizing a top pillow and a base pillow provides numerous advantages for persons sleeping in the hemi side position. The use of a separate top pillow provides an opportunity to change firmness of a major reclining/sleeping surface by changing the stuffing/filling of the top pillow or changing the top pillow itself. The separate base pillow allows the user to have two other support surfaces and opportunity for different firmness of support.

The use of straps or other means for shaping and supporting and securing not only secures the top and base pillow together along with the first pillow case, but it further shapes the top pillow to desired configuration and provides an indentation, channel, recess or crevice to prevent the pillow construction from blocking a person's nasal openings. The use of the bottom strap further maintains the support straps in position and helps the top pillow retain its shape.

Another embodiment of the present invention could eliminate the bottom strap if the first means for shaping and securing is designed to provide support at the bottom of the base pillow. This could be accomplished by having the first means for shaping and securing make a crisscross (X) pattern underneath the base pillow. One strap could even be utilized to accomplish this. The view shown in FIG. 2 would represent what the strap would look like from the front and the bottom strap 30 would be eliminated. The bottom view would show the crisscross pattern.

When a second pillow case is utilized, the second case must have a forming means to allow the second case to conform to the shape of the indentation or recess created by the first means for shaping and securing. In the preferred embodiment shown in FIG. 3, the forming means is provided by a strap similar to the strap shown in FIG. 2. Other examples of acceptable forming means are elastic bands built into the case, or string, thread or rope built into the case. However any suitable means of allowing the second case to conform to the shape of the first case particularly in the region of the indentation or recess will suffice.

Although the major purpose of the top and base pillow construction is to support a person in hemi side position, this construction also allows a person to sleep in the prostrate position (shoulders horizontal) and supine position (back to floor or ground) also. A person resting his/her head on the end sections of the base pillow could still have an unobstructed nasal opening if facing away from the center of the pillow.

The double top pillow configuration offers the same advantages of the top and base pillow construction but is designed for two people. As mentioned previously, each person may choose to have a different firmness or level of support in their respective top pillow and this is easily accomplished because the top pillows can be easily changed or have different stuffing inserted.

The contents of the top and base pillow should not be construed as being limited to conventional pillow stuffing. Although the terms "stuffing" and "filling" have been utilized, any gas, liquid or solid suitable for filling pillows is appropriate. Additionally the material utilized for the pillow case can be any suitable material known to one skilled in the art of pillow coverings. If gas or liquid is utilized to fill the pillow, a pillow case made of non permeable material would be appropriate.

From the foregoing, the construction and utility of the two-pillow configuration as well as double top pillow configuration should be readily understood. However, because numerous changes and modifications may readily occur to those skilled in the art, it is not desired to limit the invention to the exact constructions shown and described, and accordingly, all suitable modification and equivalents may be resorted to, falling within the scope of the appended claims.

What is claimed is:

1. A multi-pillow construction comprising:

a. a base pillow having two end sections of approximately the same shape and volume, a middle section connected to and separating said end sections, said middle section having less volume than said end sections, and compartmentalization means at junctures where said middle section meets said end sections;

b. a top pillow positioned above said middle section of said base pillow;

c. a first pillow case enclosing said base pillow and said top pillow;

d. first means for supporting and shaping said top pillow and securing said top pillow to said base pillow, said first means positioned over said first pillow case, said first means forming recesses in the area where said top pillow is secured to said base pillow.

2. The multi-pillow construction of claim 1 further including a second pillow case enclosing said first pillow case, said base pillow and said top pillow; said second pillow case having forming means approximately positioned above the recesses created by the first means for support to maintain the shape of the multi-pillow construction.

3. The multi-pillow construction of claim 2, wherein said base pillow and said top pillow are filled with a solid, liquid or gaseous material.

4. The multi-pillow construction of claim 3, wherein said solid material comprises a member selected from a group consisting of feathers, polymeric foam, and natural or synthetic fibers.

5. The multi-pillow construction of claim 1 further including second means for supporting and shaping said top pillow and securing said top pillow to said base pillow, said second means positioned below said base pillow on the outside of said first pillow case to secure each of said first means for support to at least one adjacent first means for support.

6. The multi-pillow construction of claim 5 further including a second pillow case enclosing said first pillow case, said base pillow and said top pillow; said second pillow case having forming means approximately positioned above the recesses created by the first means for support to maintain the shape of the multi-pillow construction.

7. The multi-pillow construction of claim 6, wherein said base and said top pillow are filled with a solid, liquid or gaseous material.

8. The multi-pillow construction of claim 7, wherein said solid material comprises a member selected from a group consisting of feathers, polymeric foam, and natural or synthetic fibers.

9. A multi-pillow construction comprising:

a. a base pillow having two end sections of approximately the same shape and volume, two receiving sections having less volume than said end sections and positioned between said two end sections, said receiving sections separated by and connected to a middle section of approximately twice the volume of each end section and connected to and separating said receiving sections, and compartmentalization means at junctures where said receiving sections meet said end sections and where said receiving sections meet said middle section;

b. two top pillows positioned above said receiving sections of said base pillow;

c. a first pillow case enclosing said base pillow and said two top pillows;

d. first means for supporting and shaping said two top pillows and securing said two top pillows to said base pillow, said first means positioned over said first pillow case, said first means forming recesses in the areas where said two top pillows are secured to said base pillow.

10. The multi-pillow construction of claim 9 further including a second pillow case enclosing said first pillow case, said base pillow and said two top pillows; said second pillow case having forming means approximately positioned above the recesses created by said first means for support to maintain the shape of the multi-pillow construction.

11. The multi-pillow construction of claim 10, wherein said base pillow and said two top pillows are filled with a solid, liquid or gaseous material.

12. The multi-pillow construction of claim 11, wherein said solid material comprises a member selected from a group consisting of feathers, polymeric foam, and natural or synthetic fibers.

13. The multi-pillow construction of claim 9 further including second means for supporting and shaping said two top pillows and securing said two top pillows to said base pillow; said second means positioned below said base pillow on the outside of said first pillow case to secure each of said first means for support to at least one adjacent first means for support.

14. The multi-pillow construction of claim 13 further including a second pillow case enclosing said first pillow case, said base pillow and said two top pillows; said second pillow case having forming means approximately positioned above the recesses created by said first means for support to maintain the shape of the multi-pillow construction.

15. The multi-pillow construction of claim 14, wherein said base pillow and said two top pillows are filled with a solid, liquid or gaseous material.

16. The multi-pillow construction of claim 15, wherein said solid material comprises a member selected from a group consisting of feathers, polymeric foam, and natural or synthetic fibers.

* * * * *